US006626318B2

(12) United States Patent
Salcedo

(10) Patent No.: US 6,626,318 B2
(45) Date of Patent: Sep. 30, 2003

(54) TRASH DUMP WITH SAFETY COLLECTOR

(76) Inventor: Ignacio Ramirez Salcedo, Calle Isla Borneo No. 15. Col. Residencial Chiluca, Atizapan de Zaragoza, México D.F. (MX), 52930

( * ) Notice: Subject to any disclaimer, the term of this patent is extended or adjusted under 35 U.S.C. 154(b) by 0 days.

(21) Appl. No.: 09/948,231

(22) Filed: Sep. 7, 2001

(65) Prior Publication Data

US 2002/0047013 A1 Apr. 25, 2002

Related U.S. Application Data

(63) Continuation of application No. PCT/MX00/00018, filed on Apr. 3, 2000.

(30) Foreign Application Priority Data

Apr. 7, 1999 (MX) ..... 993220

(51) Int. Cl.[7] ..... B65D 51/00
(52) U.S. Cl. ..... 220/495.06; 220/908; 220/908.1
(58) Field of Search ..... 220/495.06, 908, 220/908.1

(56) References Cited

U.S. PATENT DOCUMENTS 3,691,943 A 9/1972 Boyd ..... 100/215
4,126,241 A * 11/1978 Klosk ..... 220/908 X
4,715,498 A * 12/1987 Hanifl ..... 220/908 X
4,890,733 A * 1/1990 Anderson ..... 220/908 X
4,911,294 A * 3/1990 Russo et al. ..... 220/908 X
5,007,547 A 4/1991 Corbett ..... 220/476
5,097,750 A * 3/1992 Oldham et al. ..... 220/908 X
5,147,056 A 9/1992 Ma ..... 220/263
5,387,735 A * 2/1995 Ponsi et al. ..... 220/908 X
5,588,358 A * 12/1996 Klepacki et al. ..... 220/908 X
5,884,556 A * 3/1999 Klepacki et al. ..... 220/908 X
6,241,115 B1 * 6/2001 Delmerico et al. .... 220/495.06

FOREIGN PATENT DOCUMENTS

EP 0338929 10/1989
ES 1040332 4/1999

* cited by examiner

*Primary Examiner*—Steven Pollard
(74) *Attorney, Agent, or Firm*—Ostrolenk, Faber, Gerb & Soffen, LLP

(57) ABSTRACT

The present invention refers to a trash dump which solves and satisfy the current requirements. The new trash dump is embedded to a wall or gate or to any other place where can be used. This new trash dump has the peculiarity that the user can deposit the trash inside the dump without going out from the building and the personnel of the trash collection service, can pick the trash disposed in the collector up through an opening in the wall, which has a collector with a safety system of rotatory doors. Said safety system allows, at the same time, the easy operation of the trash dump and avoids any intrusion.

24 Claims, 9 Drawing Sheets

TRASH DUMP WITH SAFETY COLLECTOR

CROSS-REFERENCE TO RELATED APPLICATION

This is a continuation application of PCT/MX00/00018 filed Apr. 3, 2000, which PCT application claims priority of Mexico Application number 993220 filed Apr. 7, 1999.

TECHNICAL FIELD

The present invention relates to a trash dump that due to its special design is different from those already known, since it is more functional, more esthetic, safer, accessible and easily handled internally, as well as externally to the building where it is embedded.

BACKGROUND OF THE INVENTION

Current trash dumps, do not solve the problem of containing the trash in a functional, esthetic and simultaneously, a hygienic way. One of the issues that is not satisfied by current dumps is the esthetic, since these are only an added object to the facade and not integrated to it. Likewise, they are not functional because they do not solve the problem of an inadequate containment of the wastes, and on the other hand, they are not either hygienic, since these dumps permit access to a great number of animals, such as rodents and insects. In view of the above, the trash dump with safety collector of this invention, solves the current problems for the handling of trash, since it is a trash dump which is embedded in a wall or gate and is accessible from outside by means of an opening in the wall and it has a collector which comprises a safety system of rotatory doors which permit:

- personnel of a trash collection service to pick up the trash disposed in the collector by opening a door without the need of entering the property, and even by means of some lock, if that is desired;
- the user can deposit the trash inside the dump, without leaving the building by opening some particular lock;
- people from outside cannot come into the building, even by entering in the trash dump.

Likewise, since it is a dump which is kept hermetically closed, it will be free of animals and insects, impermeable and will not give off bad odors to the outside or within the building. In addition, it is durable because it is not subject to the inadequate handling and it will not obstruct the public way.

SUMMARY OF THE INVENTION

The present invention refers to a trash dump which solves and satisfies the current needs, since such a dump can be embedded in the wall of a house, in the gate or in some other place enabling the people who live in the house can deposit the trash in the respective dump inside, instead of going out from the building, and the people in charge of the trash collection to pick up the trash from outside. This new trash dump has a safety doors system which allow the easy handling and make it safer, since it prevents the introduction into the house of the people who collect the trash.

BRIEF DESCRIPTION OF THE DRAWINGS

The details of the features of this invention are shown in the following description and in the attached drawings, serving the reference numbers therein to denote the parts shown in the Figures.

DETAILED DESCRIPTION OF THE PREFERRED EMBODIMENT

Figure 1:
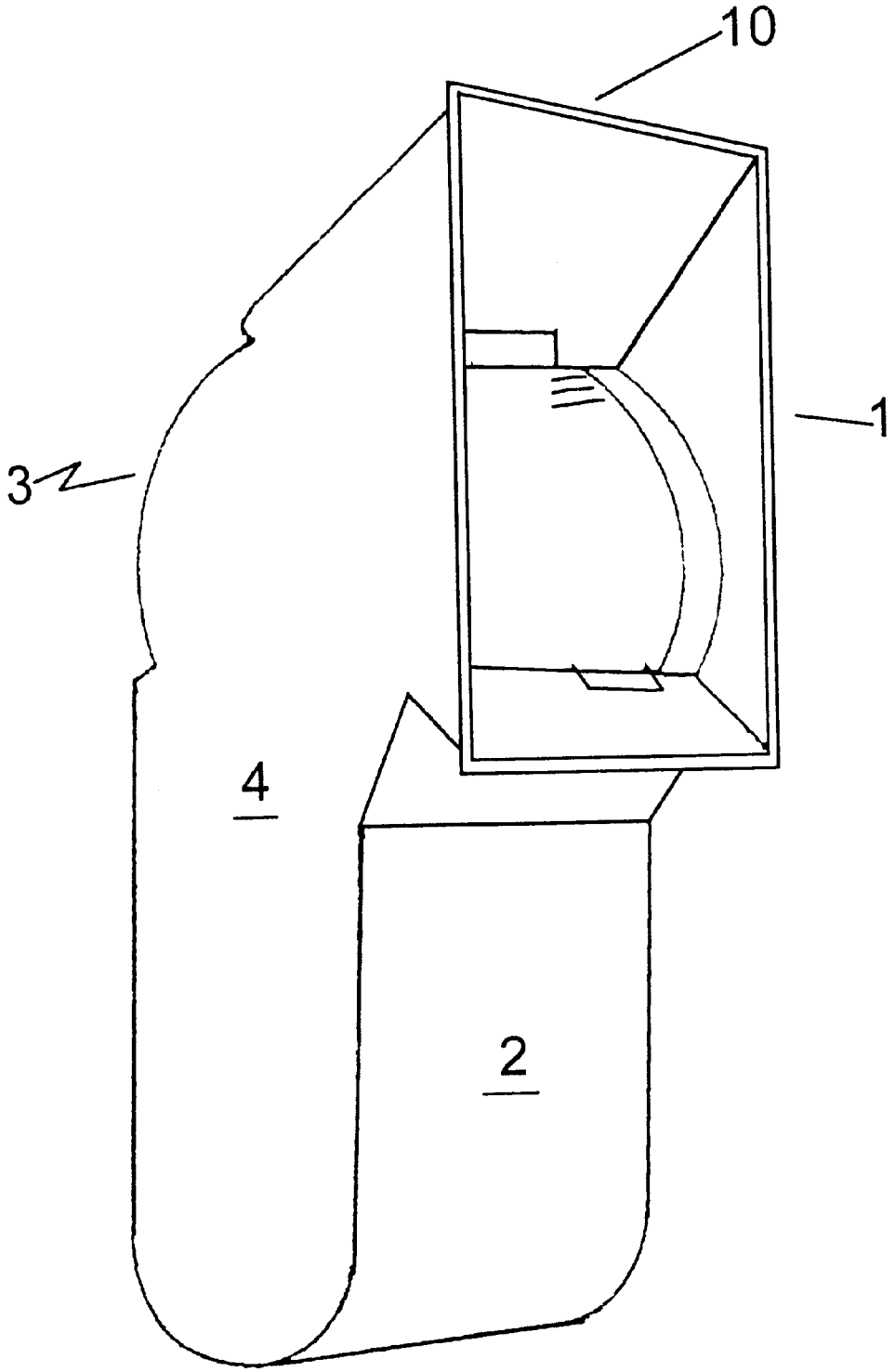
FIG. 1 is a perspective view of the front-side part of the trash dump with safety collector.
Figure 2:
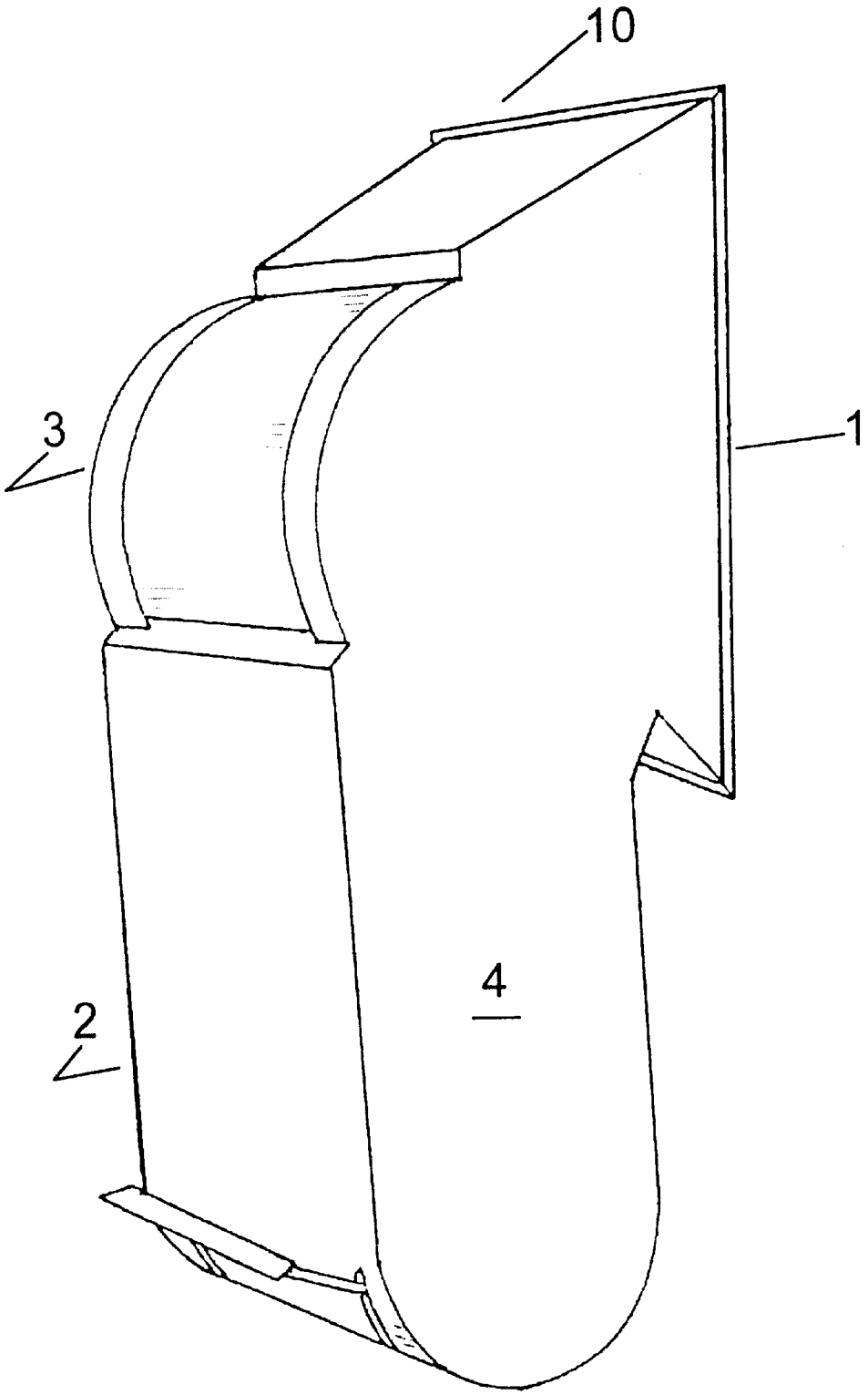
FIG. 2 is a perspective view of the rear-lateral part of the trash dump with safety collector.

Referring in detail to the drawings, and initially to FIGS. 1 and 2, they show a preferred embodiment of the trash dump with safety collector 10 according to this invention. It includes a section for the extraction of trash 1 which comprises a header with walls disposed in a truncated rectangular shape; a section for placing the trash which makes up the longitudinal part of the collector 10; a section for the introduction of the trash 3, and a side section 4 for the access to the internal mechanism of the collector 10.

Figure 3:
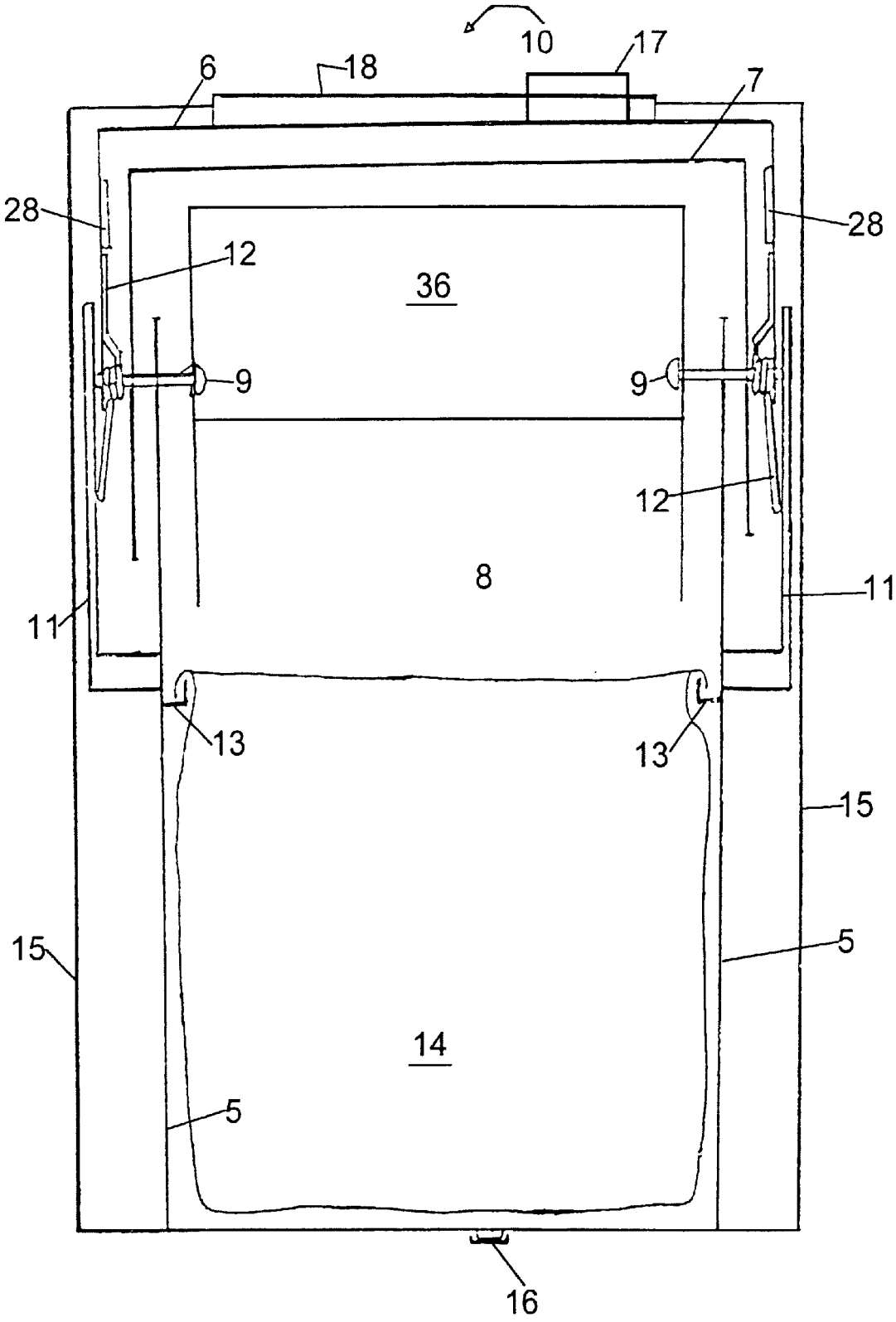
FIG. 3 is a plan view of a front cut of the dump, which shows how the doors of the safety collector are disposed over the lateral axes.

FIG. 3 shows a cross section cut of the front part of the trash dump 10, which shows the parts that make up the internal doors system of the dump. This system is supported by an internal lid 5 and an external lid 15, so that a support 11 is placed on the external face of the internal lid 5, made of a metallic strip. All of the parts are joined by welding, so that the support has a configuration with the shape of an inverted V (see FIGS. 4 through 8) and the support is joined to the peripheral part of the body 2 of the dump 10 (see FIG. 6).

An axis 9 is disposed fixed to the top of each support 11 perpendicularly, so that the axis supports, and at the same time, allows the oscillatory movement of a first external door 6, a rear door 7 and an internal door 8.

The actuation of the doors 7 and 8 is carried out by the mechanism located in the side parts of the trash dump, which are discussed below. The external door 6 has a convex shape having side walls, which are embedded in each of the axes 9. The door is actuated by a handle 17 that is joined to the external face of the sides, so that the person collecting trash only moves the handle 17 upwardly to allow access to the inside of the dump, and moves the handle downwardly for closing the dump. For safety purposes, the door 6 has attached a pair of pivot springs 12 for causing self-closing of said door. The springs are supported by axes 9 so that one leg of the spring makes contact with the internal side face which includes the door 6 and the other leg of the spring 12 makes contact with the support means 11.

Figure 8:
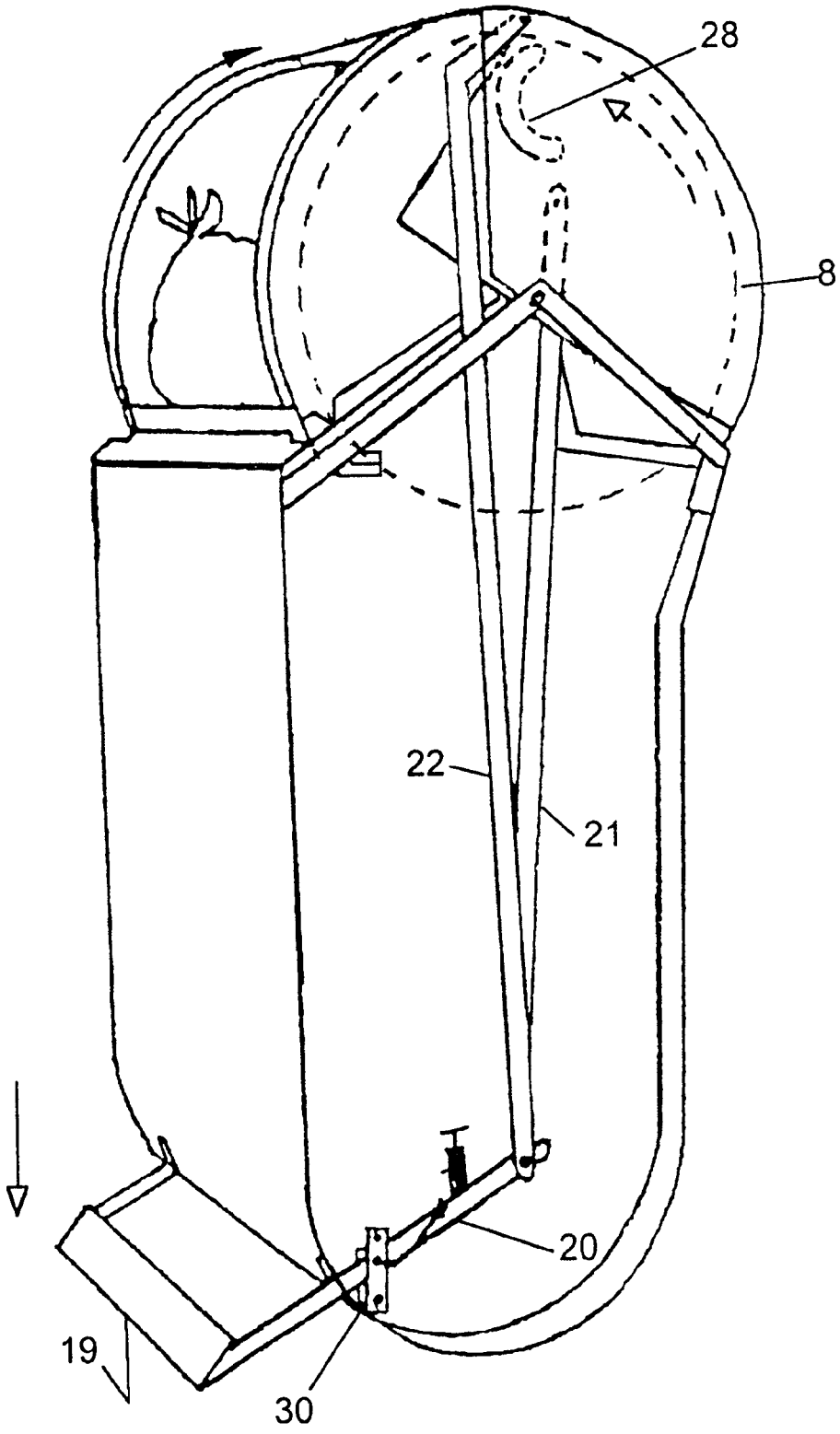
FIG. 8 is a perspective view of the rear-side part of the trash dump, where the actuating pedal for actuating the rear and inside doors can be seen.

The bumper mean 28 are illustrated in FIGS. 3 and 8. They comprise a pair of flanges of curved configuration, whose function is to prevent the external door 6 and the rear door 7 from being opened at the same time. The operation of the bumper mean is discussed below. A second support 13 with an L-shape to support a bag of trash 14, is disposed on the internal face of the internal side wall 5. A drainage plug 16 is disposed at the bottom part of the trash dump 10, to allow the leakage of fluids for the internal washing of the dump. A strap 18 coupled within the slot formed in the body of the dump is disposed at the top of the dump and serves as a stand for a safety lock (not shown).

Figure 4:
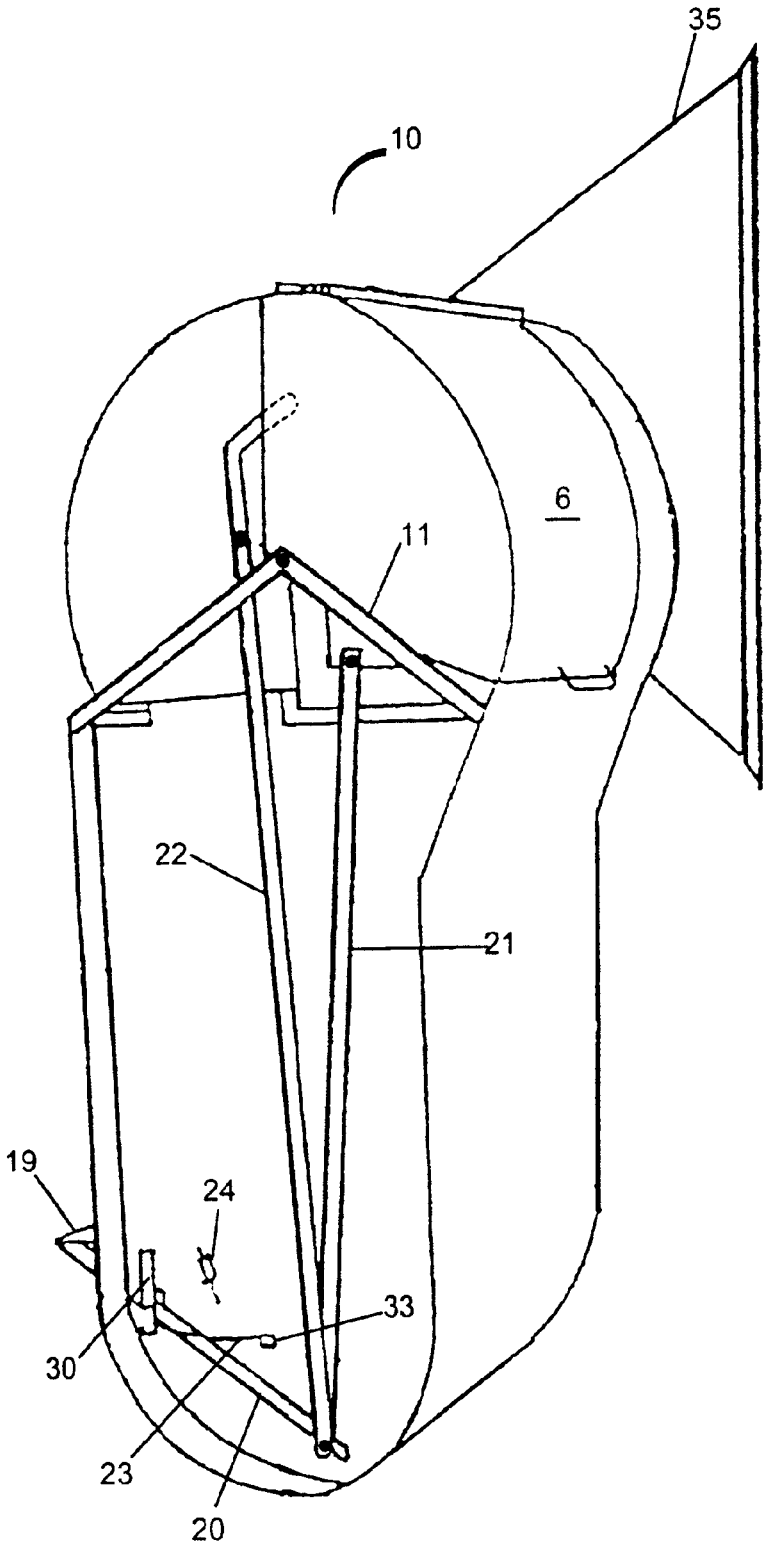
FIG. 4 is a perspective view of the front-side part of the trash dump where the side lid has been removed, allowing viewing of the mechanism, this view being identical at the opposite side.

FIGS. 4 through 8 show the operation of doors 7 and 8, which are located on each side of the trash dump 10, as well as the internal mechanism of the dump. A part of the header 1, shown with reference numeral 35, is a part of the trash dump and it is useful to be assembled in an opening (not shown) within a wall, as in FIG. 9. A mechanism for the actuation of doors 7 and 8 is shown, and FIG. 4 shows the trash dump 10 in a state without actuating. The mechanism is comprised basically of a pair of rods 21 and 22. At the lower part, the rods join together to a first end of an actuating lever 20, so that this lever is supported by a pedal support 30 which serves as the point of support. The actuating lever 20 is moved upwardly and downwardly in relation to the rods. The second end of the actuating lever 20 protrudes from the dump 2 through a pair of slots 32 (see FIG. 6). A wide plate 19 is attached in the ends and it functions as an actuating pedal.

Spring mean are adjacent to the pedal support 30, wherein the spring 23 comprises a small resilient stem. One end of said stem is joined to the body of the pedal support 30 and the other end of the stem only makes contact with a bumper 33. The bumper 33 is joined to the external face of the side wall 5 by welding. The second spring 24 is placed at the top, next to the stem spring 23, and this one operates as a bumper for the actuating lever 20, when a force is applied on the pedal 19.

One of the side walls of the internal door 8 is joined to the top of the bar 21 by a pin to permit the upward and downward movement of the door. The bar 22 is identified as a "stick" type bar that is joined to the external side wall of the door 7 by the second pin means, so that door 7 is also moved upwardly and downwardly.

Figure 5:
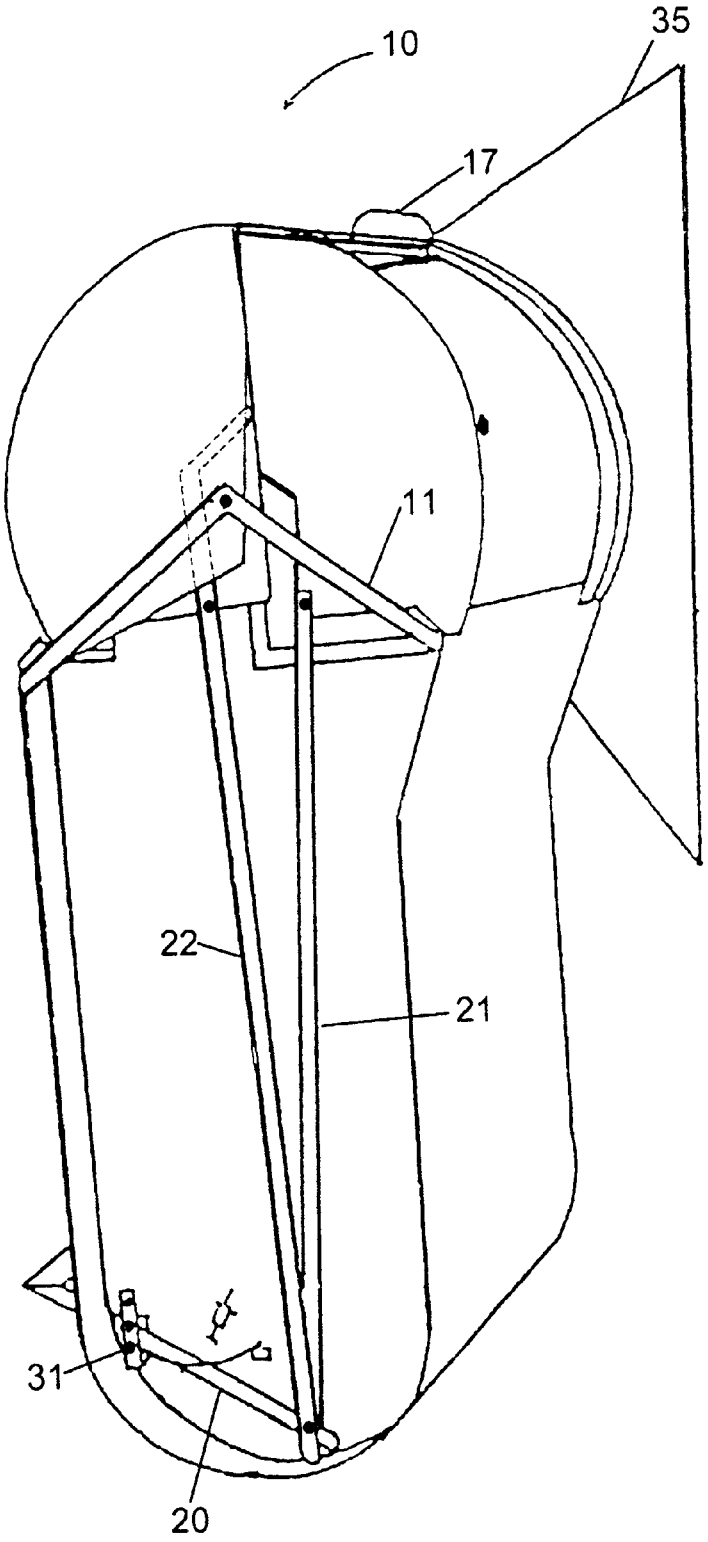
FIG. 5 is a view similar to FIG. 4, but with the external door opened by mean of an actuating handle.
Figure 6:
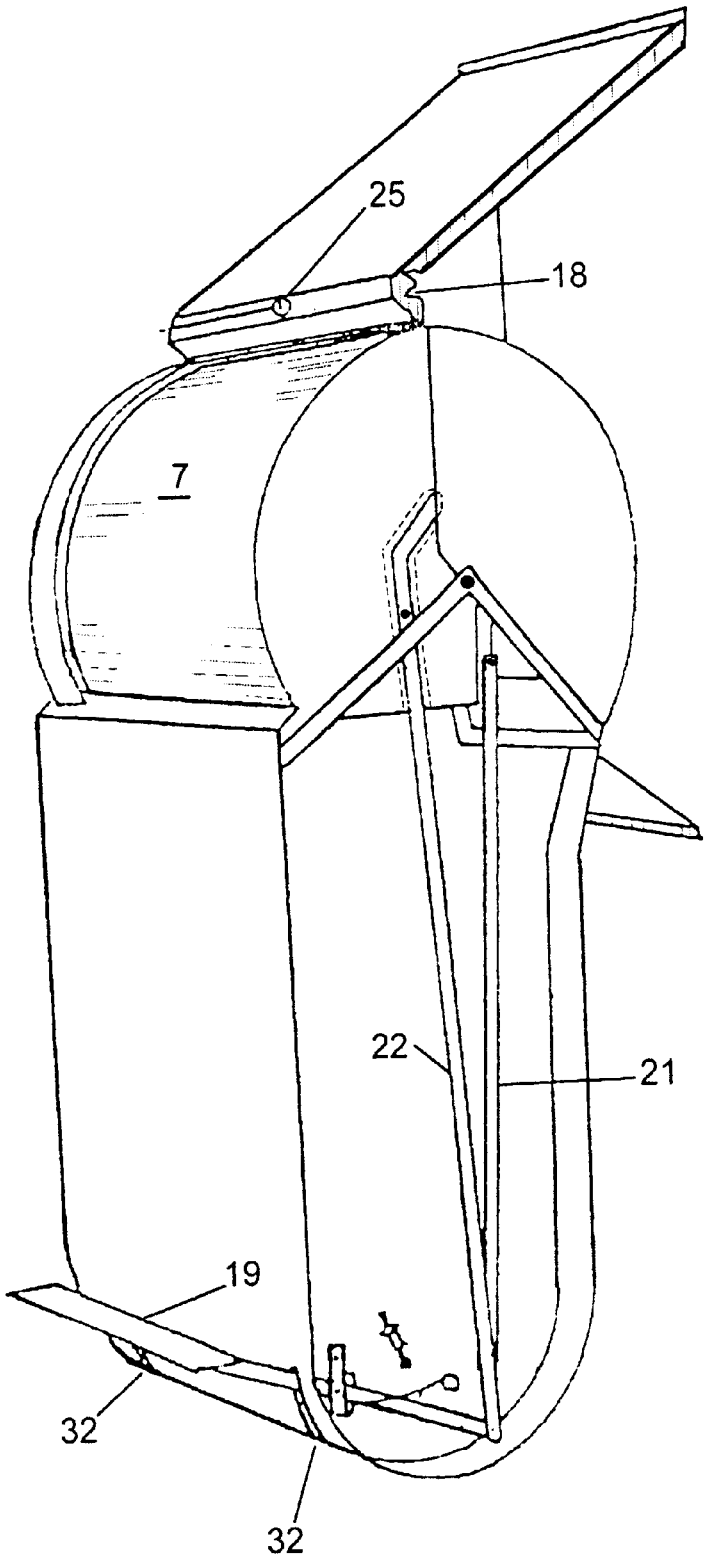
FIG. 6 is a perspective view of the rear-side part of the trash dump, showing an internal door which closes access to the inside of the building.
Figure 7:
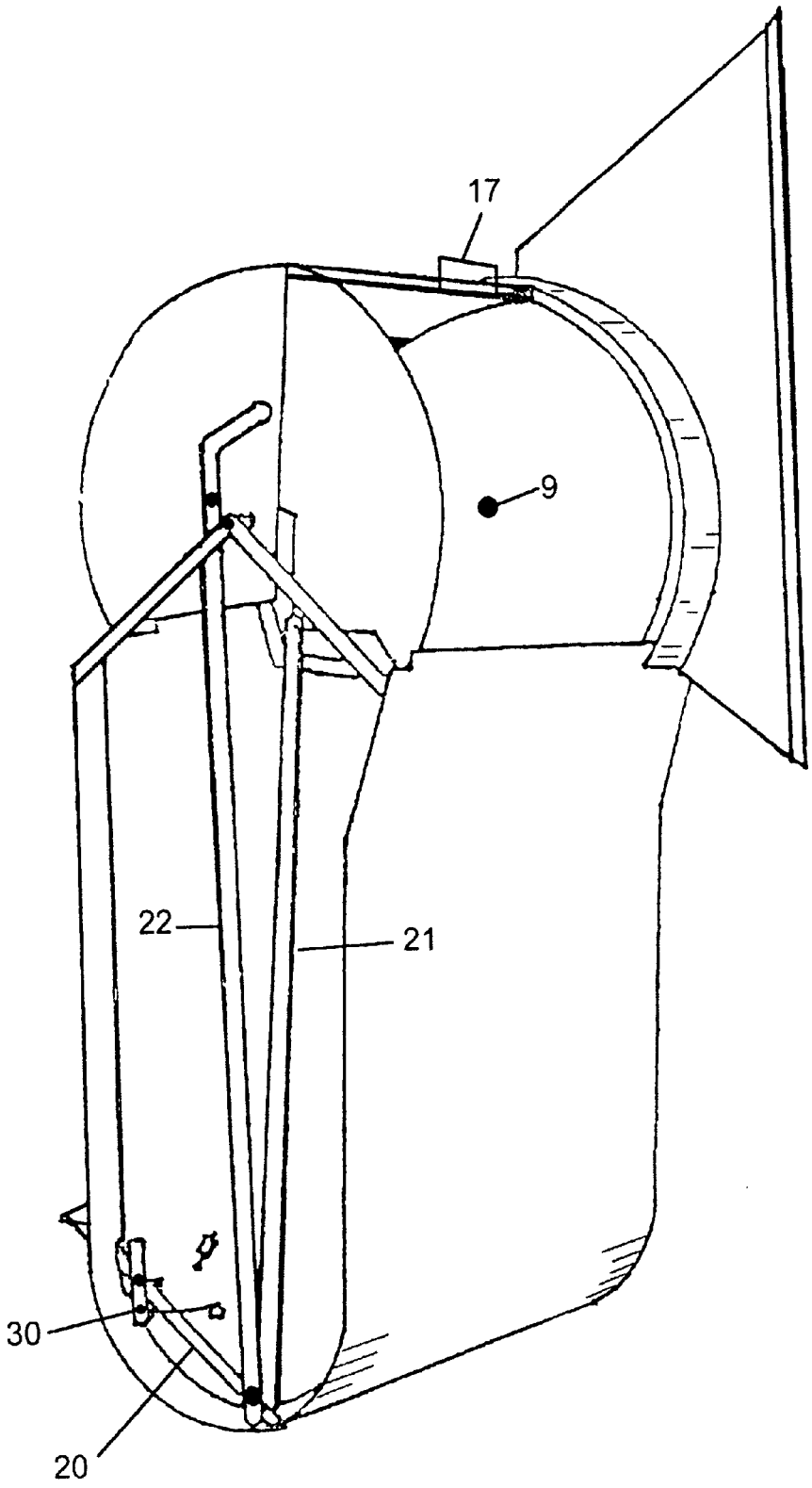
FIG. 7 is a perspective view of the front-side part of the trash dump, wherein the side door has been removed, allowing viewing of the pedal mechanism that actuates the internal doors.

As mentioned before, FIG. 4 shows each of the doors when they are not actuated. FIG. 5 shows the raising of the door 6 but without actuating the doors mechanism. FIG. 6 shows the doors without actuating. The safety means 25 can also be seen, wherein the said safety means comprises a latch or lock placed over the flange 18 to prevent raising of the door 6. This is accomplished by a key (not shown) which actuates the pin of the lock or latch. This pin penetrates in a hole (not shown) disposed at the top of the trash dump 10, and prevents in this way the introduction into the inside of the trash dump of strange people or simply the introduction of any object when nobody is inside the building. FIG. 7 is the same as FIG. 4, but with the door 6 opened. One of the internal side circular walls of door 8 can also be seen with the head of axis 9, which allows the oscillatory movement of door 8.

FIG. 8 shows the actuation of doors 7 and 8 when the pedal 19 is pushed downward. This causes the actuating lever 20 joined to the pedal to move the bars 21 and 22 upwardly, to cause the rotatory movement of the doors over axis 9, causing the door 7 to tend to turn clockwise and causing the circular walls of the internal door 8 to turn counter clockwise.

Introducing the trash inside the dump 2 is done as follows. First, before actuating the pedal 19 downwardly, there is a radial sectional part 36 of internal door 8 behind the external door 6, which serves as a support for the trash (see FIG. 3). This sectional part 36 is in an overlapped position at the same distance of the rear part of section 3 of the dump 10. When pedal 19 is pushed, the door 7 turns upstream (FIG. 8), and the radial section 36 of door 8 tends to go downstream, so that the spring 24 functions as a bumper for the turn limit of both doors. Then the radial section 36 is placed in a transverse position. In that moment, the user can place the trash over the same.

Once the trash has been placed on the radial section 36 of door 8, the user can stop applying force on the pedal 19, which causes the return of the internal and rear doors, by the pushing action of the springs 23 and 24 over the actuating lever 20. At that moment, the trash falls by gravity inside the bag for the collection of trash 14.

As mentioned above, the bumper means 28 in FIG. 8, comprise a pair of flanges of curved configuration, which function as safety means. When an individual from outside wishes to get into the building, both the external door 6 and the rear door 7 must be actuated at the same time to provide a passage for entering the building. In order to prevent this, a pair of flanges 28 is disposed, one on each side of the internal side wall that forms part of door 6. When both doors 7 and 6 are actuated at the same time, the stick type bars 22 make contact with the flanges 28. This causes both doors to be opened only for a relatively short distance, and in this way, it is avoided any intrusion.

Figure 9:
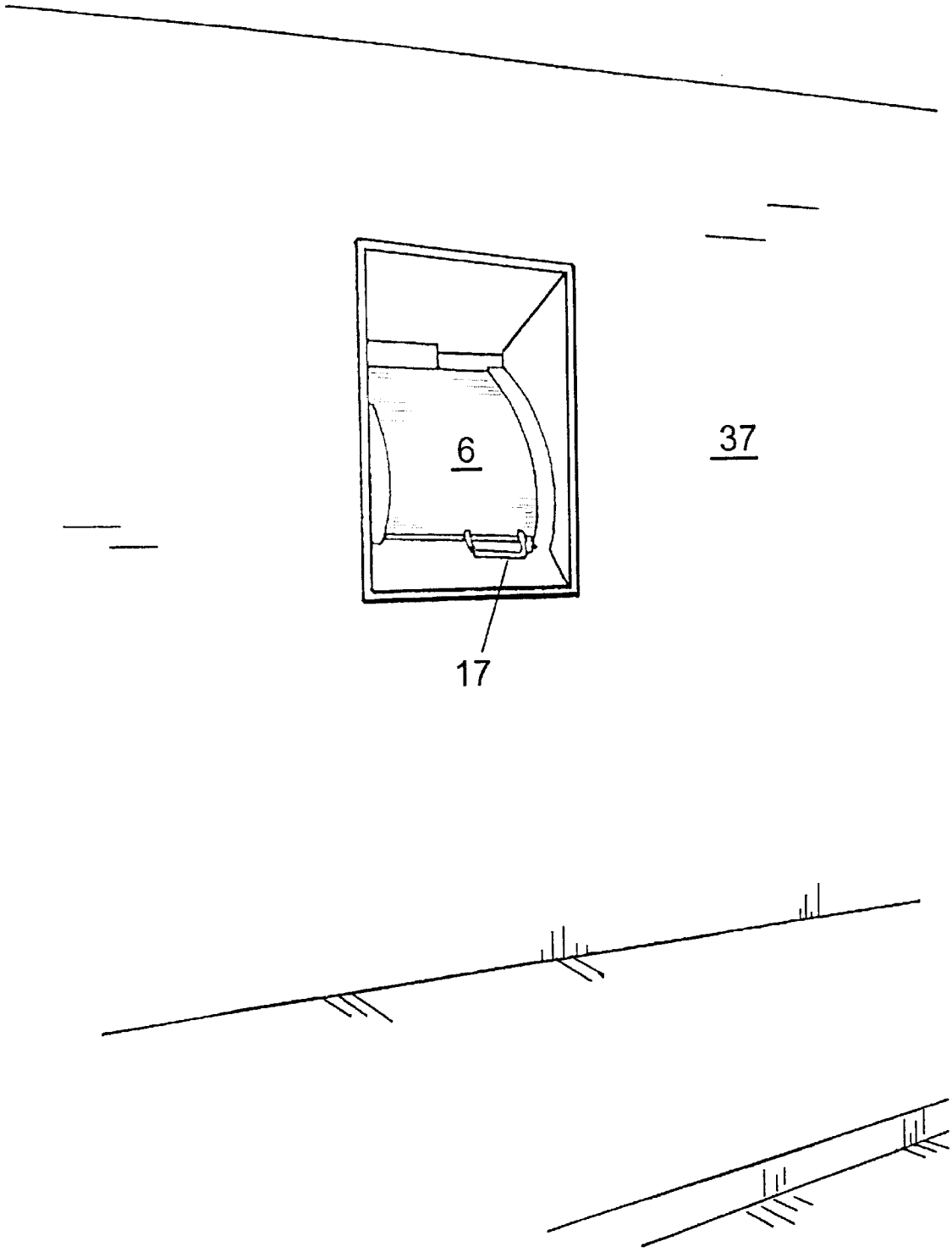
FIG. 9 is a front perspective view of the trash dump installed in a wall, as seen from the street.

As an example, in FIG. 9, the trash dump 10 is installed in a wall 37. There the embedded header of the dump provides it a pleasant and hygienic appearance and avoids the entry of animals.

Although the present invention has been described in relation to a particular embodiment thereof, many other variations and modifications and other uses will become apparent to those skilled in the art. It is preferred, therefore, that the present invention be limited to not by the specific disclosure herein, but only by the appended claims.

What is claimed is:

1. A trash dump comprising:

a body in which trash is placed and from which the trash is removed;

a header on the body;

an openable and closeable external door at the header at one side of the body;

an internal door inside the external door, the internal door being openable to permit access into the body and closeable to block access into the body, a rear door on a side of the body away from the external door, the rear door being openable to enable access into the body, and the rear door being closeable;

the internal and the rear doors being supported in the body for being moveable between respective open and closed conditions thereof;

a door operating mechanism connected with the rear and internal doors, an operator accessible at the exterior of the body and connected with the operating mechanism for simultaneous opening and closing of the rear and internal doors through operation of the mechanism.

2. The trash dump of claim 1, wherein the header has walls projecting outwardly from the body defining a truncated rectangular shape and surrounding the external door.

3. The trash dump of claim 1, wherein the operating mechanism is disposed toward at least one side of the body, a side section of the body at the one side where the mechanism is located, and the side section including lids openable for access to the mechanism.

4. The trash dump of claim 3, further comprising an internal lid in the trash dump and the doors are supported at the internal lid of the trash dump; a support in the body and the lid is on the support.

5. The trash dump of claim 4, wherein the support has the configuration of an inverted V and the support is joined at the top of the body, the doors are supported on the body above the inverted V of the support.

6. The trash dump of claim 4, wherein an axis is positioned at the top of the support which axis supports the doors and also permits oscillatory movement of the supported external, rear and internal doors.

7. The trash dump of claim 3, further comprising a support for the doors in the body; an axis at the support which axis supports the doors and also permits oscillatory movement of the supported external, rear and internal doors.

8. The trash dump of claim 7, wherein the external door has a generally concave shape, and a handle on the external door for enabling upward and downward oscillation movement of the external door.

9. The trash dump of claim 7, further comprising internal pivot springs connected with the external door and supported on the body for self-closing the external door.

10. The trash dump of claim 9, wherein the springs connected with the external door include axes for supporting the springs; each spring includes one leg which contacts an internal side of the external door and another leg which contacts the support for the doors for urging the external door normally to the closed condition.

11. The trash dump of claim 1, wherein the mechanism for the rear and internal doors comprises:

a pair of rods including a first rod in the form of a stick-type bar respectively connected to the rear door and a second rod respectively connected to the internal door;

an actuating lever below the rear and internal doors, and connected with the pair of rods and supporting an end region of each of the rods, wherein the actuating lever is moveable up and down for moving the rods up and down;

the operator being external to the dump and operable for moving the actuating lever up and down, such that upward and downward movement of the actuating lever correspondingly moves the first and second rods upwardly and downwardly, which moves the internal door and the rear door together upwardly and downwardly, with the upward movement thereof opening the rear and internal doors and the downward movement thereof closing the rear and internal doors.

12. The trash dump of claim 11, further comprising the actuating lever extending from the interior to the exterior to the dump and the operator including a pedal connected with the actuating lever for moving the actuating lever to raise the rods.

13. The trash dump of claim 11, wherein the rear and internal doors are on axes and are rotateable in their movement around their axes.

14. The trash dump of claim 13, wherein the first and second rods are joined to each other and to the actuating lever at a union pin at which the rods are relatively pivotable with respect to the lever.

15. The trash dump of claim 14, wherein the internal door has a circumferential side wall to which the first rod is connected and the rear door has an external side wall to which the second rod is connected.

16. The trash dump of claim 11, further comprising a spring connected with the actuating lever for normally urging the actuating lever downwardly for moving the rods to close the rear and internal doors.

17. The trash dump of claim 16, wherein the spring comprises a resilient stem having one end joined to the actuating lever and another end joined to the actuating lever body of the dump.

18. The trash dump of claim 17, further comprising a second spring near the first spring and positioned to act as a bumper against upward movement of the actuating lever.

19. The trash dump of claim 13, wherein the rear door rotates in one direction toward the internal door and the internal door rotates in the opposite direction toward the rear door as the rear and internal doors open upon raising of the respective first and second rods.

20. The trash dump of claim 13, further comprising a flange disposed on the interior of the body and positioned to be engaged by at least one of the bars as the doors are opening such that when the external and rear doors are opened simultaneously, both doors are opened a relatively short distance, as compared with the opening thereof under operation of the actuating lever.

21. The trash dump of claim 11, further comprising a radial section at the internal door for supporting trash thereon.

22. The trash dump of claim 1, further comprising supports inside the body of the dump for supporting an internal bag for collection of trash in the bag.

23. The trash dump of claim 1, further comprising a metal strap supported toward the top of the body of the dump and for serving as a stand for a safety lock which avoids upward movement of the external door.

24. The trash dump of claim 1, further comprising a drain disposed at the lower part of the dump for draining of material from the body of the dump.

* * * * *